US009738074B2

(12) United States Patent
Tomimatsu

(10) Patent No.: US 9,738,074 B2
(45) Date of Patent: Aug. 22, 2017

(54) LIQUID EJECTING HEAD AND LIQUID EJECTING APPARATUS

(71) Applicant: SEIKO EPSON CORPORATION, Tokyo (JP)

(72) Inventor: Shingo Tomimatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/273,492

(22) Filed: Sep. 22, 2016

(65) Prior Publication Data

US 2017/0087835 A1 Mar. 30, 2017

(30) Foreign Application Priority Data

Sep. 24, 2015 (JP) ..... 2015-186807

(51) Int. Cl.
*B41J 2/19* (2006.01)
*B41J 2/14* (2006.01)

(52) U.S. Cl.
CPC ..... *B41J 2/1433* (2013.01)

(58) Field of Classification Search
CPC ..... B41J 2/1433; B41J 2/19; B41J 2202/00; B41J 2202/01; B41J 2202/07; B41J 2002/14306
See application file for complete search history.

(56) References Cited

U.S. PATENT DOCUMENTS 6,296,351 B1 * 10/2001 Tanaka ..... B41J 2/14274 347/68
2003/0214560 A1 * 11/2003 Yonekubo ..... B41J 2/14274 347/65
2007/0263041 A1 11/2007 Owaki

FOREIGN PATENT DOCUMENTS

JP 2007-301736 11/2007

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A liquid ejecting head includes a head main body in which a nozzle N that ejects liquid is formed; a case member which includes a space that stores liquid to be supplied to the nozzle and an opening that communicates with the space; a flexible seal plate that closes the opening from an outside of the case member; and an overhang portion disposed on an end of the opening and having an inclined surface that overhangs from an inner peripheral surface of the opening.

9 Claims, 10 Drawing Sheets

LIQUID EJECTING HEAD AND LIQUID EJECTING APPARATUS

BACKGROUND

1. Technical Field

The present invention relates to techniques for ejecting liquid such as ink.

2. Related Art

Liquid ejecting heads for liquid ejecting apparatuses such as ink jet printers have been proposed, in which liquid such as ink supplied from a liquid storage chamber (reservoir) to a plurality of pressure chambers is ejected through nozzles by generating pressure in the respective pressure chambers. While the reservoir communicates with a plurality of pressure chambers, it is necessary to prevent a pressure change in a pressure chamber from effecting on another pressure chamber via the reservoir. For example, Japanese Patent No. 4258668 discloses a configuration in which an opening is formed in a space of the reservoir and the opening is sealed by a flexible sealing film (also referred to as a compliance substrate). In this configuration, a fine pressure change in the reservoir is absorbed by the sealing film so that a pressure change in each pressure chamber does not effect on other pressure chambers via the reservoir.

In the configuration that seals an opening of the reservoir with a sealing film as disclosed in Japanese Patent No. 4258668, an intersection between the inner peripheral surface of the opening and the inner wall surface of the sealing film is an angular shape. This angular shape may often induce stagnation of liquid, leading to a problem of air bubbles being accumulated. Further, if the shape of the opening is devised taking into account only the prevention of stagnation of liquid, an area of the opening excessively decreases and an absorption effect on pressure change by the seal plate may be reduced.

SUMMARY

An object of some aspects of the invention is to prevent decrease in the absorption effect on pressure change while improving discharge of air bubbles.

Embodiment 1

According to a preferred embodiment (Embodiment 1) of the present invention, a liquid ejecting head includes a head main body in which a nozzle that ejects liquid is formed; a case member which includes a space that stores liquid to be supplied to the nozzle and an opening that communicates with the space; a flexible seal plate that closes the opening from an outside of the case member; and an overhang portion disposed on an end of the opening and having an inclined surface that overhangs from an inner peripheral surface of the opening. In Embodiment 1, the space that stores liquid to be supplied to the nozzle and the opening that communicates with the space are formed in the case member, the opening is closed by the flexible seal plate, and the overhang portion having the inclined surface which overhangs from the inner peripheral surface of the opening is disposed on an end of the opening. Accordingly, at the end of the opening where air bubbles are likely to be accumulated, a flow is formed along the inclined surface of the overhang portion. In this configuration, stagnation of liquid at the end of the opening is prevented, and air bubbles are easily discharged. Further, since the overhang portion is partially disposed on the end of the opening, a sufficient area of the opening can be ensured and decrease in absorption effect on pressure change by the seal plate can be prevented. Therefore, according to Embodiment 1, discharge of air bubbles can be improved while preventing decrease in absorption effect on pressure change by the seal plate.

Embodiment 2

In a preferred example (Embodiment 2) of Embodiment c 1, the inclined surface of the overhang portion is inclined relative to the inner peripheral surface of the, opening and the inner wall surface of the seal plate. In Embodiment 2, since the inclined surface of the overhang portion is inclined relative to the inner peripheral surface of the opening and the inner wall surface of the seal plate, a flow along the inclined surface of the overhang portion is formed between the inner peripheral surface of the opening and the inner wall surface of the seal plate. Accordingly, a smooth flow of liquid is obtained between the inner peripheral surface of the opening and the inner wall surface of the seal plate, thereby improving discharge of air bubbles.

Embodiment 3

In a preferred example (Embodiment 3) of Embodiment 2, the inclined surface of the overhang portion includes a first inclined surface section which is inclined relative to the inner peripheral surface of the opening and the inner wall surface of the seal plate, and a second inclined surface section which is inclined relative to the inner peripheral surfaces of the opening, the inner peripheral surfaces being adjacent to and intersect with each other. In Embodiment 3, the inclined surface of the overhang portion includes the first inclined surface section which is inclined relative to the inner peripheral surface of the opening and the inner wall surface of the seal plate and the second inclined surface section which is inclined relative to the inner peripheral surfaces of the opening, the inner peripheral surfaces being adjacent to and intersect with each other. Accordingly, an ink flow along the first inclined surface section is formed between the inner peripheral surfaces of the opening and the inner peripheral surface of the opening, and an ink flow along the second inclined surface section is formed between the inner peripheral surfaces of the opening, the inner peripheral surfaces being adjacent to and intersect with each other. This facilitates discharge of air bubbles, thereby improving discharge of air bubbles.

Embodiment 4

In a preferred example (Embodiment 4) of Embodiment 1, the inclined surface of the overhang portion is inclined relative to the inner peripheral surfaces of the opening, the inner peripheral surfaces being adjacent to and intersect with each other, and the inner wall surface of the seal plate. In Embodiment 4, the inclined surface of the overhang portion is inclined relative to the inner peripheral surfaces of the opening, the inner peripheral surfaces being adjacent to and intersect with each other, and the inner wall surface of the seal plate. Accordingly, it is possible to form a smooth flow along one inclined surface from the ink flow between the inner peripheral surface of the opening and the inner wall surface of the seal plate and the ink flow between the inner peripheral surfaces of the opening which are adjacent to and intersect with each other. This facilitates discharge of air bubbles, thereby improving discharge of air bubbles.

Embodiment 5

In a preferred example (Embodiment 5) of any one of Embodiment 1 to Embodiment 4, the overhang portion has a thickness between the inclined surface and the inner wall surface of the seal plate. In Embodiment 5, since the overhang portion has a thickness between the inclined surface and the inner wall surface of the seal plate, a thickness of the case member in which the opening is formed can be ensured, thereby improving a mechanical strength.

Embodiment 6

In a preferred example (Embodiment 6) of any one of Embodiment 1 to Embodiment 5, the opening includes a first inner peripheral surface extending in a first direction, the overhang portion is disposed on an end of the first inner peripheral surface, and a length of the overhang portion in the first direction is not more than 1/8 of the entire length of the first inner peripheral surface. If the length of the overhang portion in the first direction is too large, an area of the opening is excessively decreased and thus the absorption effect on pressure change by the seal plate is also decreased. However, according to Embodiment 6, since the length of the overhang portion in the first direction is not more than ⅛ of the entire length of the first inner peripheral surface in the first direction, an area of the opening is not excessively decreased and discharge of air bubbles can be improved.

Embodiment 7

In a preferred example (Embodiment 7) of any one of Embodiment 1 to Embodiment 6, the inclined surface of the overhang portion is a curved surface. In Embodiment 7, since the inclined surface of the overhang portion is a curved surface, an ink flow along the inclined surface may be smooth compared with the case where the inclined surface is a flat surface, thereby improving discharge of air bubbles.

Embodiment 8

In a preferred example (Embodiment 8) of any one of Embodiment 1 to Embodiment 7, the case member is made of a resin material, and the overhang portion integrally formed with the case member. As a result, the number of parts for the liquid ejecting head is reduced and a manufacturing process is simplified.

Embodiment 9

A liquid ejecting apparatus according to a preferred embodiment (Embodiment 9) of the present invention includes a transportation mechanism that transport a medium; and the liquid ejecting head that ejects liquid onto the medium according to any one of Embodiment 1 to Embodiment 8. A preferred example of the liquid ejecting apparatus is a printing apparatus that ejects ink onto the medium such as a print sheet. However the applications of the liquid ejecting apparatus according to the present invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
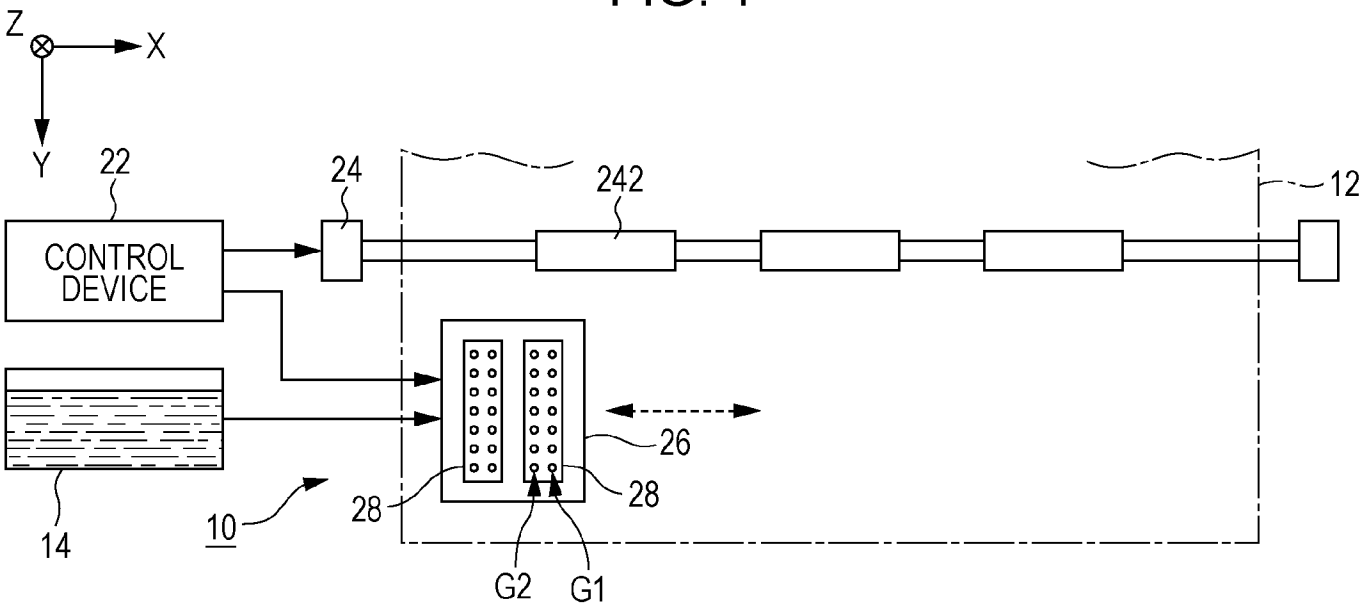
FIG. 1 is a block diagram of a printing apparatus according to a first embodiment of the present invention.

First, an ink jet printing apparatus according to a first embodiment of the present invention will be described. FIG. 1 is a partial block diagram of a printing apparatus 10 according to the first embodiment. The printing apparatus 10 is a preferred example of a liquid ejecting apparatus that ejects ink as an example of liquid onto a medium (ejection target) 12 such as a print sheet. As shown in FIG. 1, the printing apparatus 10 includes a control device 22, a transportation mechanism 24, a carriage 26 and a plurality of liquid ejecting heads 28. A liquid container (cartridge) 14 that stores ink is mounted on the printing apparatus 10.

The control device 22 integrally controls the respective components of the printing apparatus 10. The control device 22 includes CPU, ROM, RAM and the like. The ROM stores a variety of programs such as a program for a printing operation performed by the CPU. Further, the RAM temporarily stores calculation results of the CPU or a variety of data processed by operating the programs.

The transportation mechanism 24 is made up of a transportation roller 242 and the like, and transports a medium 12 in the Y direction under control of the control device 22. Ink is supplied from the liquid container 14 to the respective liquid ejecting heads 28. The liquid ejecting heads 28 allow ink to be ejected through a plurality of nozzles (ejection holes) N onto the medium 12 under control of the control device 22.

The liquid ejecting heads 28 are mounted on the carriage 26. The carriage 26 is a structure that houses and supports the liquid ejecting heads 28, and repeatedly reciprocates in an X direction (second direction) which crosses a Y direction (first direction) by a drive mechanism (which is not shown in the figure) including a transportation belt, a motor and the like under control of the control device 22. In parallel with transportation of the medium 12 by the transportation mechanism 24 and repeated reciprocation of the carriage 26, the liquid ejecting heads 28 eject ink onto the medium 12 to form a desired image on the surface of the medium 12. The structures of the transportation mechanism 24 and the carriage 26 are not limited to the above example. A direction which is vertical to an X-Y plane (for example, a plane parallel to the surface of the medium 12) is hereinafter referred to as a Z direction. A direction in which the respective liquid ejecting heads 28 eject ink (typically, a vertical direction) corresponds to the Z direction.

Figure 2:
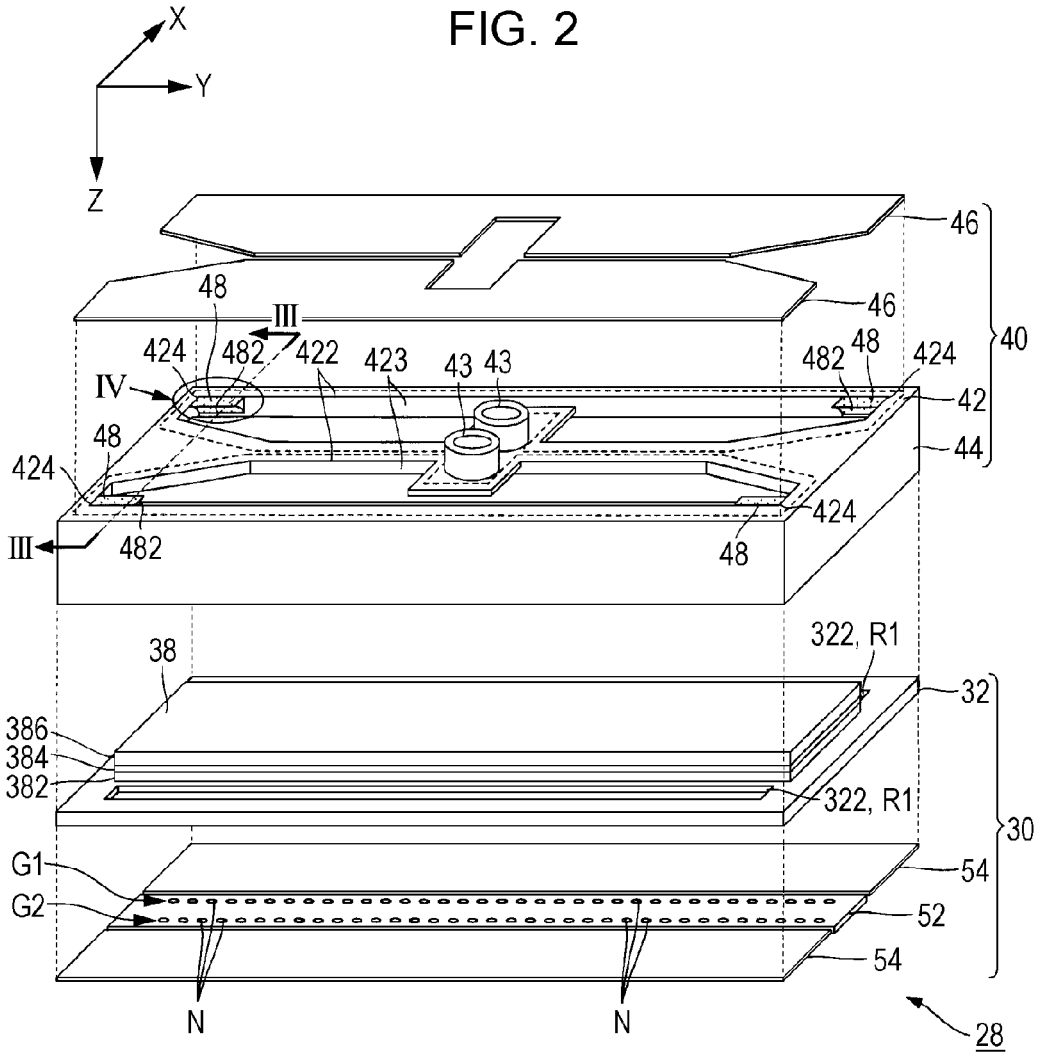
FIG. 2 is an exploded perspective view of a liquid ejecting head.
Figure 3:
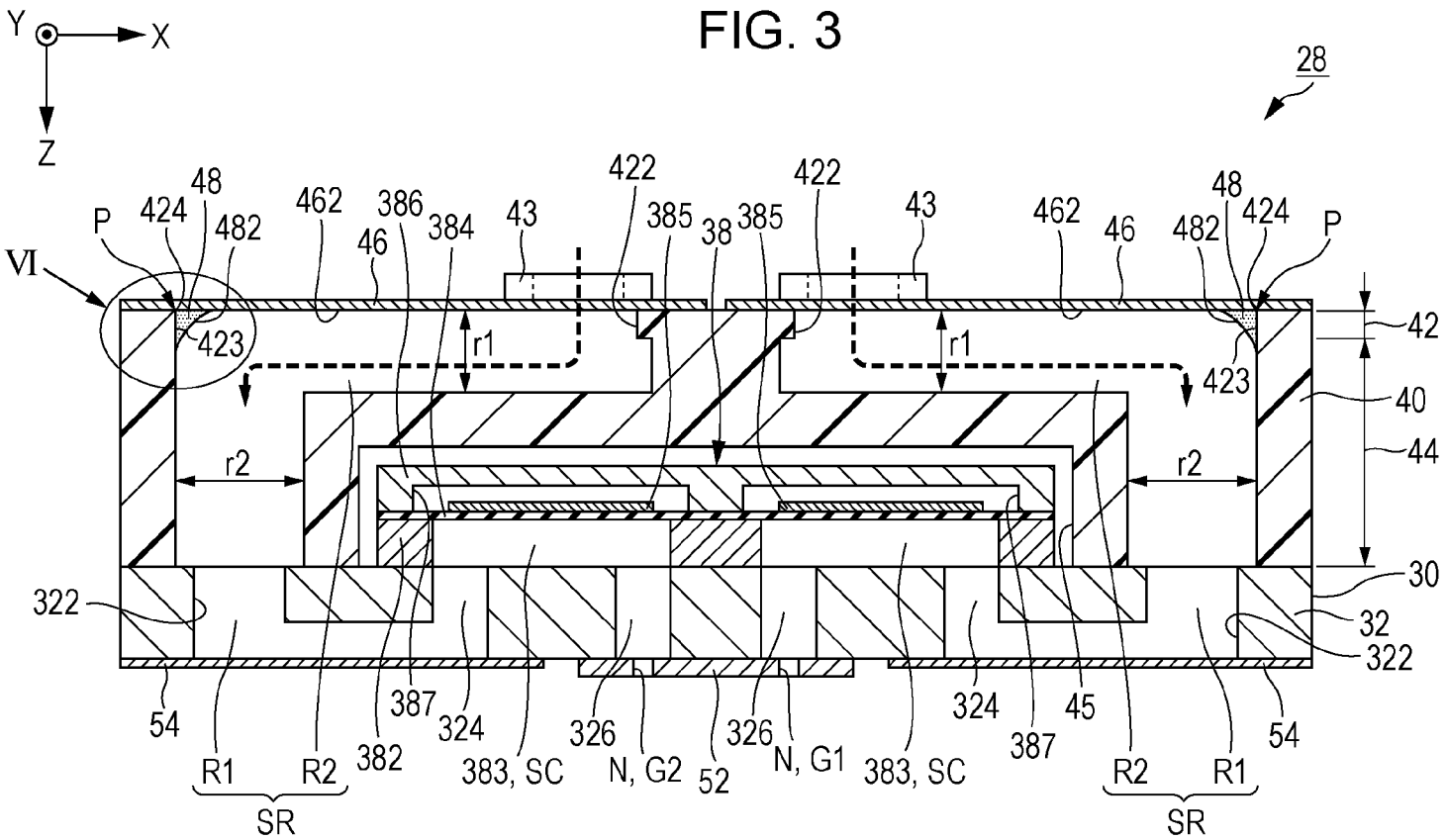
FIG. 3 is a cross sectional view of the liquid ejecting head taken along the line III-III of FIG. 2.

FIG. 2 is an exploded perspective view of a single liquid ejecting head 28. FIG. 3 is a cross sectional view of the liquid ejecting head 28 taken along the line III-III of FIG. 2. As shown in FIGS. 2 and 3, the liquid ejecting head 28 includes a main body 30 which has an ejection surface on which nozzles N are formed and a case member 40 fixed (joined) to the main body 30. The head body 30 is a structure formed of a flow path substrate 32, a nozzle plate 52 having the plurality of nozzles N and a seal plate (compliance substrate) 54 disposed on one side (a surface oriented in the positive Z direction) of the flow path substrate 32, and a stack section 38 including a pressure chamber substrate 382 stacked on the other side (a surface oriented in the negative Z direction) of the flow path substrate 32. The components of the head main body 30 are fixed to each other, for example, by an adhesive.

The nozzle plate 52 is a flat plate that forms the ejection surface on which the plurality of nozzles N are arrayed in the Y direction (first direction). The nozzle plate 52 is made of, for example, a silicon material. The plurality of nozzles N is made up of two nozzle rows G1, G2. Each of the nozzle rows G1, G2 is a group of the plurality of nozzles N arrayed in the Y direction. The arrangement of the nozzle rows G1, G2 is not limited to that illustrated in this embodiment. For example, the nozzle rows G1, G2 may be offset in the Y direction. Further, the rows of the nozzles formed in the nozzle plate 52 are not limited to two, but may be one.

As shown in FIG. 3, in the liquid ejecting head 28 according to the present embodiment, a structure corresponding to the nozzle row G1 and a structure corresponding to the nozzle row G2 are disposed in a substantially line symmetric manner, and both structures are substantially the same. Accordingly, the following description will be made focusing on the elements corresponding to the nozzle row G1, and the description of the elements corresponding to the nozzle row G2 is omitted for convenience's sake.

The flow path substrate 32 is a flat plate that forms an ink flow path. In the flow path substrate 32 of the present embodiment, an opening 322 that forms a first space R1 which is part of a liquid storage chamber SR is formed on each side of the stack section 38. Further, a plurality of supply flow paths 324 and a plurality of communication flow paths 326 are formed. The supply flow paths 324 and the communication flow paths 326 are through holes formed for the corresponding nozzles N, and the opening 322 is a through hole (opening port) which is common for the plurality of nozzles N. The respective supply flow paths 324 communicate with the opening 322. The flow path substrate 32 is made of, for example, a silicon material.

The seal plate 54 is a flexible film and serves as a vibration absorber that absorbs change in pressure of ink in the liquid storage chamber SR (first space R1). As illustrated in FIG. 3, the seal plate 54 seals the first space R1 and the plurality of supply flow paths 324 of the flow path substrate 32, and forms a bottom of the liquid storage chamber SR. Although FIG. 3 shows an example in which the first space R1 corresponding to the nozzle row G1 and the first space R1 corresponding to the nozzle row G2 are seales by separate seal plates 54, the configuration is not limited thereto, and a single seal plate 54 may be continuous across both first spaces R1.

The stack section 38 is formed by stacking the pressure chamber substrate 382 that forms a pressure chamber SC which communicates with the nozzles N, a vibration plate 384 and a protective plate 386 in this order. However, the configuration is not limited thereto, and the stack section 38 may be configured without the protective plate 386. The pressure chamber substrate 382 has a plurality of openings 383 that form the pressure chamber SC which communicates with the respective nozzles N. The pressure chamber substrate 382 is made of, for example, a silicon material similarly to the flow path substrate 32.

The vibration plate 384 is disposed on the pressure chamber substrate 382 on a surface opposite to the flow path substrate 32. The vibration plate 384 is a flat plate which is elastically vibratable. The vibration plate 384 and the flow path substrate 32 face to each other with a space therebetween inside the openings 383 formed in the pressure chamber substrate 382. The space between the flow path substrate 32 and the vibration plate 384 inside the openings 383 of the pressure chamber substrate 382 forms a pressure chamber SC (cavity) that generates pressure for ejecting ink through the respective nozzles N. The respective supply flow paths 324 of the flow path substrate 32 communicate the liquid storage chamber SR, which will be described later, and the pressure chamber SC, and the respective communication flow paths 326 of the flow path substrate 32 communicate the pressure chamber SC and the nozzles N.

A plurality of piezoelectric elements 385 which correspond to different nozzles N (pressure chamber SC) are formed on the vibration plate 384 on the surface opposite to the pressure chamber substrate 382. The piezoelectric element 385 is a stack body having a piezoelectric body between the opposed electrodes. The respective piezoelectric elements 385 individually vibrate by a drive signal supplied by the control device 22. The protective plate 386 is an element that protects the piezoelectric elements 385, and is fixed to the surface of the pressure chamber substrate 382 (vibration plate 384) by using, for example, an adhesive. The piezoelectric elements 385 are housed in a recess 387 formed on the protective plate 386 on a surface facing the vibration plate 384. When the piezoelectric elements 385 vibrate in response to the drive signal supplied by the control device 22, the vibration plate 384 vibrates in cooperation with the piezoelectric elements 385. This changes the pressure of ink in the pressure chamber SC, thereby allowing ink to be ejected from the nozzles N. As such, the piezoelectric element 385 serves as a pressure generation element that changes the pressure in the pressure chamber SC and thereby ejects ink in the pressure chamber SC from the nozzles N.

A surface of the case member 40 which faces the positive Z direction (hereinafter, referred to as a "connection surface") is fixed to a surface of the flow path substrate 32 oriented in the negative Z direction by using an adhesive. The case member 40 is made of a molding resin material such as a plastic material. In the case where the case member 40 is formed by a molding resin material, the case member 40 can be integrally formed by injection molding of the molding resin material.

The case member 40 is a case that stores ink supplied to a plurality of pressure chambers SC. The case member 40 is a structure which includes a second space R2 which forms the liquid storage chamber SR (reservoir). The second space R2 is a recess which is open to the flow path substrate 32, and is formed into a shape elongated in the Y direction. As shown in FIG. 3, the second space R2 includes a first portion r1 which is parallel to a plane which includes the Y direction (first direction) and the X direction (second direction) and a second portion r2 which is vertical to a plane which includes the Y direction (first direction) and the X direction (second direction). Since ink flows from the first portion r1 to the second portion r2, the first portion r1 is an upstream side and the second portion r2 is a downstream side.

The second space R2 is open in the positive Z direction. The second space R2 is closed by a peripheral edge of the opening 322 of the flow path substrate 32 in the state that the second space R2 communicates with the opening 322 that forms the first space R1 of the flow path substrate 32. The space formed by communicating the second space R2 of the case member 40 with the first space R1 of the flow path substrate 32 forms the liquid storage chamber SR. Furthermore, a recess 45 is formed between the second space R2 which corresponds to the nozzle row G1 and the second space R2 which corresponds to the nozzle row G2. The recess 45 has a depth in which the stack section 38 including the pressure chamber substrate 382 is housed. The recess 45 is open in the positive Z direction. The opening of the recess 45 is closed when adhered to the flow path substrate 32 in the state that the stack section 38 is housed in the recess 45.

The case member 40 includes a top surface 42 and a side surface 44. The top surface 42 and the side surface 44 form a wall that separates (surrounds) the second space R2. The top surface 42 is a portion located on the side opposite to the flow path substrate 32 with the second space R2 interposed therebetween. The side surface 44 stands on the peripheral edge of the flow path substrate 32 on the surface facing the negative Z direction. The bottom of the side surface 44 is a connecting surface connected to a surface of the flow path substrate 32 which faces the negative Z direction.

On the top surface 42, introduction ports 43 that introduce ink into the liquid storage chamber SR are formed. The introduction port 43 communicates the second space R2 of the case member 40 and the outside of the case member 40. More specifically, the introduction port 43 is located on the side opposite to the side surface 44 in plan view with the second portion r2 of the second space R2 interposed therebetween, and communicates with the first portion r1 of the second space R2.

The liquid storage chamber SR made up of the first space R1 and the second space R2 is a common liquid chamber for the plurality of nozzles N, and stores ink supplied from the liquid container 14 to the introduction port 43. As shown by the dotted arrow in FIG. 3, the ink supplied from the liquid container 14 to the introduction port 43 flows from the introduction port 43 to the side surface 44 in the first portion r1 of the second space R2, and changes the flow direction in the second portion r2 into the vertical direction (the positive Z direction). As such, the flow path is formed in the case member 40 so as to flow from the introduction port 43 to the side surface 44 and change the flow direction into the vertical direction along the side surface 44.

Thud, ink which flows from the first portion r1 to the second portion r2 in the liquid storage chamber SR is divided into the plurality of supply flow paths 324 and supplied to the respective pressure chambers SC in a parallel manner to fill the pressure chambers SC. Then, due to pressure change in response to the vibration of the vibration plate 384, the ink flows out from the pressure chamber SC and is ejected to the outside through the communication flow path 326 and the nozzle N. That is, the pressure chamber SC serves as a space that generates pressure for ejecting ink through the nozzles N, and the liquid storage chamber SR serves as a space (common liquid chamber) that stores ink supplied to the plurality of pressure chambers SC.

On the top surface 42 of the case member 40, openings 422 each of which communicates with the first portion r1 of the second space R2 are formed. Specifically, the opening 422 extends in the positive and negative Y directions on both sides of the introduction port 43. The opening 422 communicates the second space R2 of the case member 40 and the outside of the case member 40. Of the inner peripheral surface 423 of the opening 422 shown in FIG. 2, the opposing inner peripheral surfaces 423 which extend in the Y direction are substantially parallel across the entire length in the Y direction in plan view as seen in the Z direction, and are slightly bent at positions close to an end on the negative Y direction side and an end on the positive Y direction side from the introduction port 43 to each end such that the width in the X direction gradually decreases toward an end 424 on the negative Y direction side and an end 424 on the positive Y direction side. However, the opening 422 is not limited to the shape shown in FIG. 2, and the opening 422 may be in a rectangular shape having the same width in the X direction from the end 424 on the negative Y direction side to the end 424 on the positive Y direction side.

As shown in FIG. 2, seal plates (compliance substrates) 46 are disposed on the top surface 42. The seal plate 46 is a flexible film similarly to the aforementioned seal plate 54, and serves together with the seal plate 54 as a vibration absorber that absorbs pressure change of ink in the liquid storage chamber SR. The seal plate 46 is disposed on the outer surface of the top surface 42 so as to seal the opening 422 and forms the inner wall surface (top wall surface) of the liquid storage chamber SR. The seal plate 46 is located in the liquid storage chamber SR upstream of the seal plate 54, and is disposed parallel to the seal plate 54. Accordingly, in the first embodiment, pressure change in the liquid storage chamber SR can be reduced by an operation of both the seal plate 54 and the seal plate 46.

The first space R1 of the liquid storage chamber SR has a configuration which seals the opening 422 by the seal plate 46. Since the inner peripheral surface 423 of the opening 422 intersects with the inner wall surface 462 of the seal plate 46, an angular corner P is formed at the intersecting position. In particular, if the corner P is formed at the midway of ink flow path which flows from the first portion r1 to the second portion r2, a flow of ink is more likely to stagnate at the corner P, leading to accumulation of air bubbles.

In the first embodiment, as shown in FIG. 2, overhang portions 48 having an inclined surface 482 which overhangs from the inner peripheral surface 423 of the opening 422 are disposed on both ends 424 in the Y direction of the openings 422. Specifically, as shown in the IV section of FIG. 2, the overhang portions 48 are each disposed at the corners P on the positive and negative sides in the Y direction (first direction), and the inclined surface 482 overhangs from the inner peripheral surface 423 adjacent to the second portion r2 toward the opposed inner peripheral surface 423, thereby preventing stagnation of ink flow at the corner P.

Figure 4:
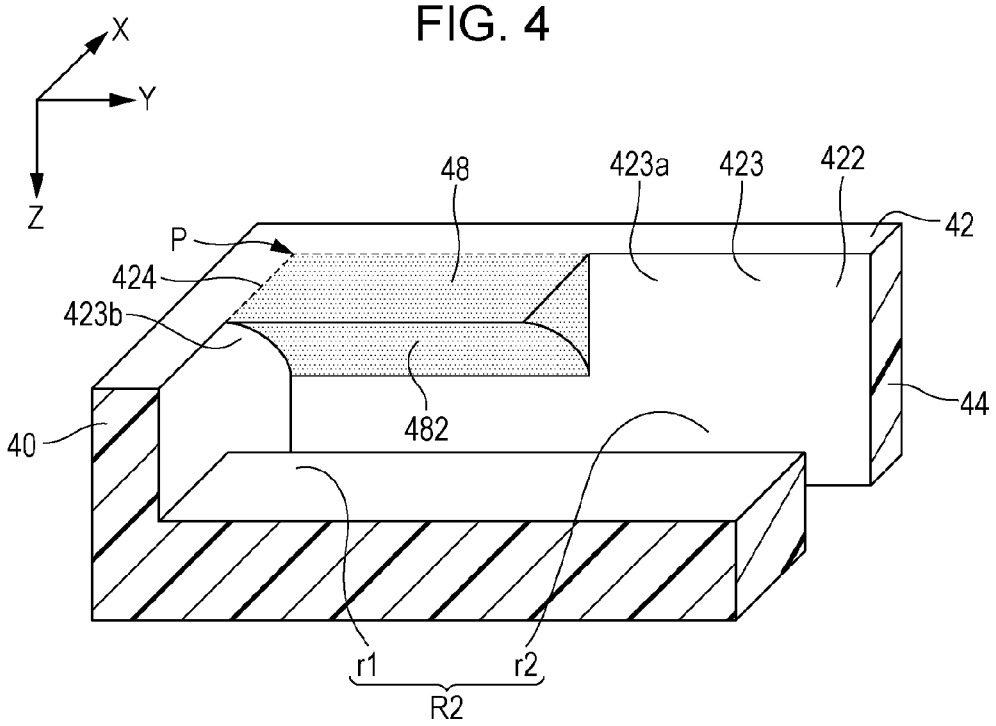
FIG. 4 is a partial perspective view of the liquid ejecting head which shows an enlarged IV section shown in FIG. 2.

A detailed description of the overhang portion 48 will be provided. FIG. 4 is an enlarged view of the IV section of FIG. 2. In FIG. 2, the overhang portions 48 are disposed on both ends 424 in the positive and negative Y directions of each of two openings 422. Since those overhang portions 48 have the same configuration, the overhang portion 48 in the IV section will be described with reference to FIG. 4.

The overhang portion 48 shown in FIG. 4, when formed of a molding resin material, can be integrally formed with the case member 40 by injection molding of the molding resin material. This allows for reduction in the number of parts for the liquid ejecting head 28 and simplification of manufacturing process. However, the overhang portion 48 may be separately provided from the case member 40. The overhang portion 48 includes the inclined surface 482 which overhangs in the negative X direction from the inner peripheral surface 423 located on the positive X direction side of the opening 422. In FIG. 4, the inclined surface 482 is formed on the underside of the overhang portion 48. The inclined surface 482 is disposed so as to be exposed to both the first portion r1 and the second portion r2 of the second space R2, and is inclined relative to both the inner peripheral surface 423 of the opening 422 and the inner wall surface 462 of the seal plate 46.

The shape of the inclined surface 482 in FIG. 4 is a recessed curved surface which is continuous from the inner wall surface 462 of the seal plate 46 to the inner peripheral surface 423 of the opening 422. Specifically, the inclined surface 482 is a curved surface which has the same curvature at any position in the Y direction when taken along the plane (X-Z plane) which is vertical to the inner peripheral surface 423 of the opening 422 and the inner wall surface 462 of the seal plate 46, that is, a cylindrical surface. Further, the shape of the inclined surface 482 is not limited to the curved surface, and may be a flat surface. However, compared with the inclined surface 482 of a flat surface, the inclined surface 482 of a curved surface can provide a smooth flow of ink along the inclined surface 482.

Figure 5:
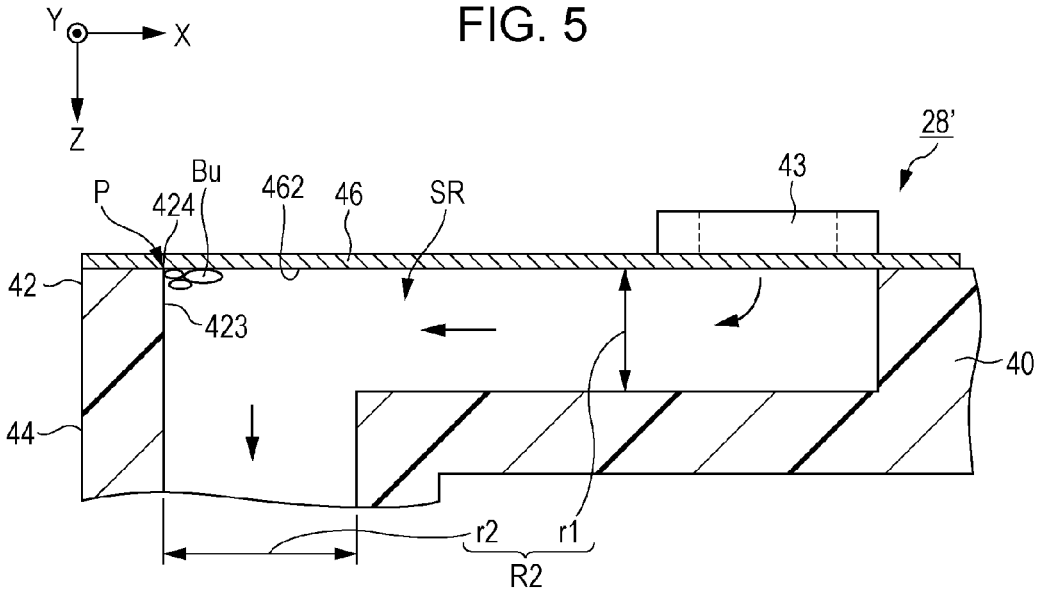
FIG. 5 is an operation explanatory view of the liquid ejecting head according to a first comparative example.
Figure 6:
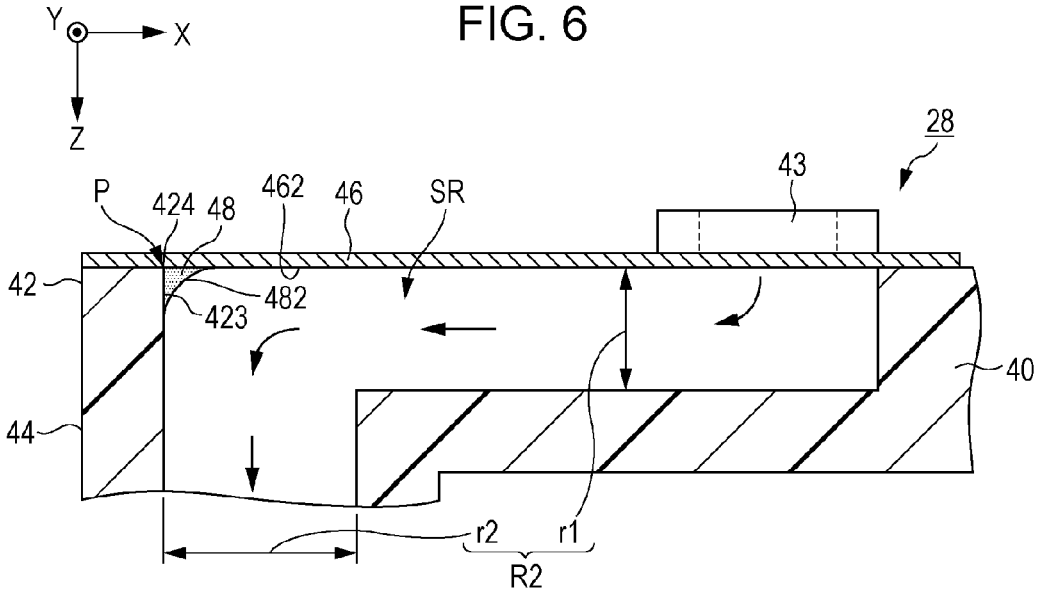
FIG. 6 is an operation explanatory view of the liquid ejecting head according to the first embodiment, and is a partial cross sectional view which shows the enlarged VI section shown in FIG. 3.

The operation and effect of the liquid ejecting head 28 which includes the overhang portion 48 having the above configuration will be described in comparison with a first comparative example. First, a focus is placed on a flow of ink when the liquid ejecting head 28 is seen in the negative Y direction. FIG. 5 is an enlarged view of a partial cross section of the liquid ejecting head 28' according to the first comparative example which does not include the overhang portion 48. FIG. 6 is an enlarged view of a partial cross section of the liquid ejecting head 28 according to the first embodiment which includes the overhang portion 48.

As shown in FIG. 5, when the overhang portion 48 is not provided on the end 424 of the opening 422, the angular corner P is provided at the intersection between the inner peripheral surface 423 of the opening 422 and the inner wall surface 462 of the seal plate 46. When focusing on a flow of ink in the liquid ejecting head 28 as seen in the negative Y direction as shown in the dotted line in FIG. 5, ink introduced from the introduction port 43 flows in the second space R2 along the inner wall surface 462 of the seal plate 46 in the first portion r1 toward the side surface 44 (in the negative X direction). When ink reaches the second portion r2, ink changes the flow direction in the second portion r2 into the positive Z direction while flowing along the inner peripheral surface 423 of the opening 422 and the inner wall surface of the side surface 44. As such, the flow of ink along the inner wall surface 462 of the seal plate 46 is changed by the inner peripheral surface 423 of the opening 422. As shown in FIG. 5, since the angular corner P is formed at a position where the flow direction changes, an ink flow is likely to stagnate and thus air bubbles Bu are likely to be accumulated.

On the other hand, in the first embodiment shown in FIG. 6, the inclined surface 482 is provided so as to be inclined relative to both the inner peripheral surface 423 of the opening 422 and the inner wall surface 462 of the seal plate 46, which forms a flow of ink along the inclined surface 482. As a result, a smooth flow of ink can be obtained at a position where the flow direction changes between the inner peripheral surface 423 of the seal plate 46 and the inner wall surface 462 of the opening 422. This facilitates discharge of air bubbles by reducing stagnation of ink on the end 424 of the opening 422, thereby improving discharging of air bubbles. Furthermore, although this embodiment shows an example in which the inner peripheral surface 423 of the opening 422 is flush with the inner wall surface of the side surface 44, the invention is not limited thereto. The inner peripheral surface 423 of the opening 422 may not be flush with the inner wall surface of the side surface 44.

Moreover, in the first embodiment, the overhang portions 48 are disposed on the end 424 on the positive Y direction side and the end 424 on the negative Y direction side of the opening 422. In this configuration, a sufficient area of the opening 422 can be ensured compared with the case where the overhang portion 48 is disposed on the entire length of the opening 422 from the positive Y direction to the negative Y direction. Accordingly, it is possible to prevent decrease in absorption effect on pressure change by the seal plate 46.

Figure 7:
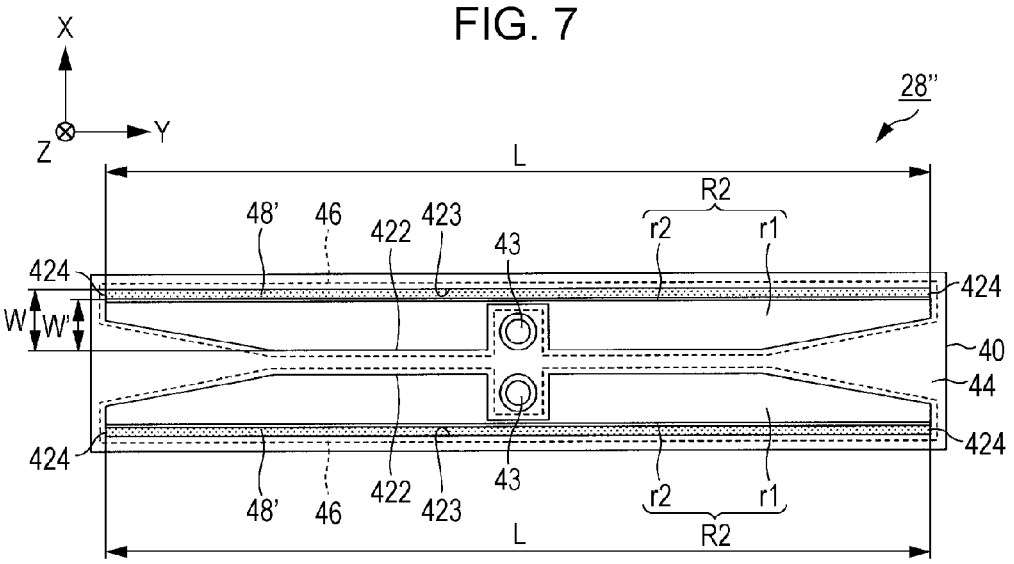
FIG. 7 is an operation explanatory view of the liquid ejecting head according to a second comparative example.
Figure 8:
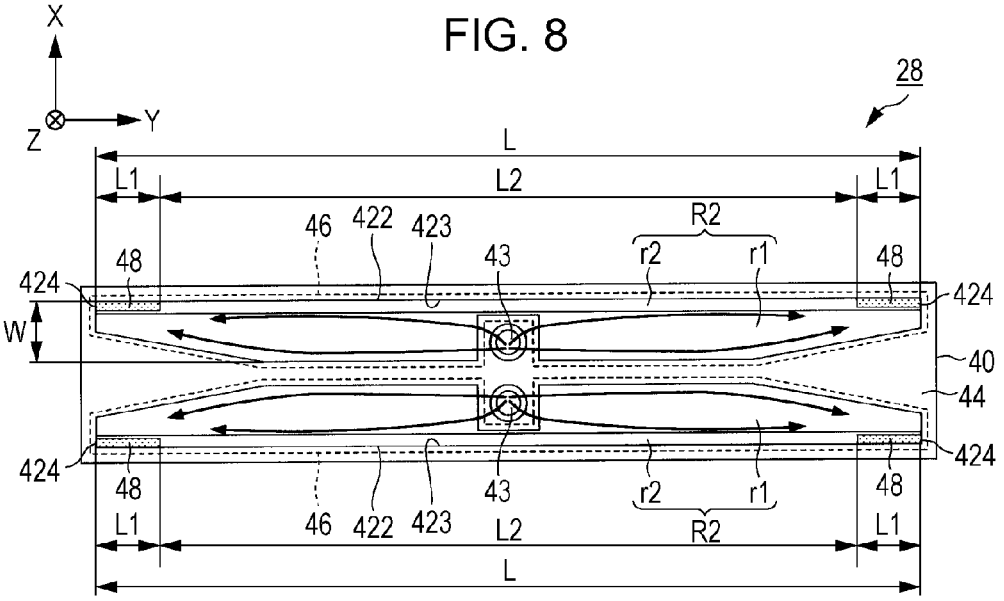
FIG. 8 is an operation explanatory view of the liquid ejecting head according to the first embodiment, and is a plan view of a case member shown in FIG. 2 as seen in the Z direction.

Next, the relation between the overhang portion 48 and an opening area of the opening 422 of the first embodiment will be further described in detail. FIG. 7 is an operation explanatory view of the liquid ejecting head 28" according to a second comparative example. FIG. 8 is an operation explanatory view of the liquid ejecting head 28 according to the first embodiment, and a plan view of the case member 40 shown in FIG. 2 as seen in the Z direction. In the second comparative example of FIG. 7, the overhang portion 48 is disposed across the entire length L of the opening 422 from the positive Y direction to the negative Y direction. On the other hand, in the first embodiment of FIG. 8, the overhang portions 48 are disposed on part of the opening 422. The overhang portion 48 has a length L1 which is smaller than the entire length L of the opening 422 in the Y direction and is disposed on each of the end 424 on the positive Y direction side and the end 424 on the negative Y direction side of the opening 422.

As shown in the second comparative example in FIG. 7, when the overhang portion 48" is disposed on the entire length of the opening 422 in the Y direction (longitudinal direction) from the positive Y direction to the negative Y direction, an area of the opening 422 is also decreased in a portion other than the ends 424 on the positive Y direction side and the negative Y direction side of the opening 422 (a portion between both ends). On the other hand, as shown in the first embodiment in FIG. 8, an area of the opening 422 is not decreased in a portion of the opening 422 other than the ends 424 on the positive Y direction side and the negative Y direction side of the opening 422, that is, a portion of a length L2 between the overhang portions 48 provided on both ends 424. The first embodiment shown in FIG. 8 can ensure a sufficient area of the opening 422 (an area of the seal plate 46 which is exposed to ink) compared with the second comparative example shown in FIG. 7.

Accordingly, it is possible to prevent decrease in absorption effect on pressure change by the seal plate 46.

The absorption effect on pressure change by the seal plate 46 depends on the width (short width) W in the short hand direction (X direction) of the opening 422 than the length L in the longitudinal direction (Y direction). Specifically, the absorption effect on pressure change by the seal plate 46 is proportional to a power of the short width W of the opening 422. Accordingly, when the short width W of the opening 422 decreases, the absorption effect on pressure change by the seal plate 46 also significantly decreases, compared with the case where the length L in the Y direction decreases. With this regard, in the second comparative example shown in FIG. 7 in which the overhang portion 48" is disposed on the entire length from the positive Y direction to the negative Y direction, the short width of the opening 422 decreases from W to W' across the entire length in the longitudinal direction. In the first embodiment shown in FIG. 8, the short width W of the opening 422 is decreased only for a portion of the length L1 in which the overhang portion 48 is disposed, and is not decreased for most of a portion of the length L2 other than the portion of the length L1. Accordingly, in the first embodiment, it is possible to prevent decrease in the short width W of the opening 422, and thus prevent decrease in absorption effect on pressure change by the seal plate 46 with high reliability.

Moreover, when focusing on a flow of ink in the liquid ejecting head 28 as seen in the positive Z direction as shown in FIG. 8, ink introduced from the introduction port 43 flows toward the end 424 on the positive Y direction side and the end 424 on the negative Y direction side. Accordingly, ink flow is particularly likely to stagnate at the end 424 of the opening 422 and thus air bubbles are likely to be accumulated. By providing the inclined surface 482 on the end 424 of the opening 422 where air bubbles are likely to be accumulated, discharge of air bubbles can be improved in a more reliable manner.

For the length of the overhang portion 48, when the length L1 in the Y direction (first direction) is too large, an area of the opening 422 is excessively decreased and thus the absorption effect on pressure change by the seal plate 46 is also decreased. When the inner peripheral surface 423*a* in the Y direction on which the overhang portion 48 is formed is a first inner peripheral surface, the length L1 of the overhang portion 48 in the Y direction is preferably not more than ⅛ of the entire length L of the inner peripheral surface (first inner peripheral surface) 423*a* of the opening 422 in the Y direction. In this configuration, an area of the opening 422 is not excessively decreased and discharge of air bubbles can be improved.

Figure 9:
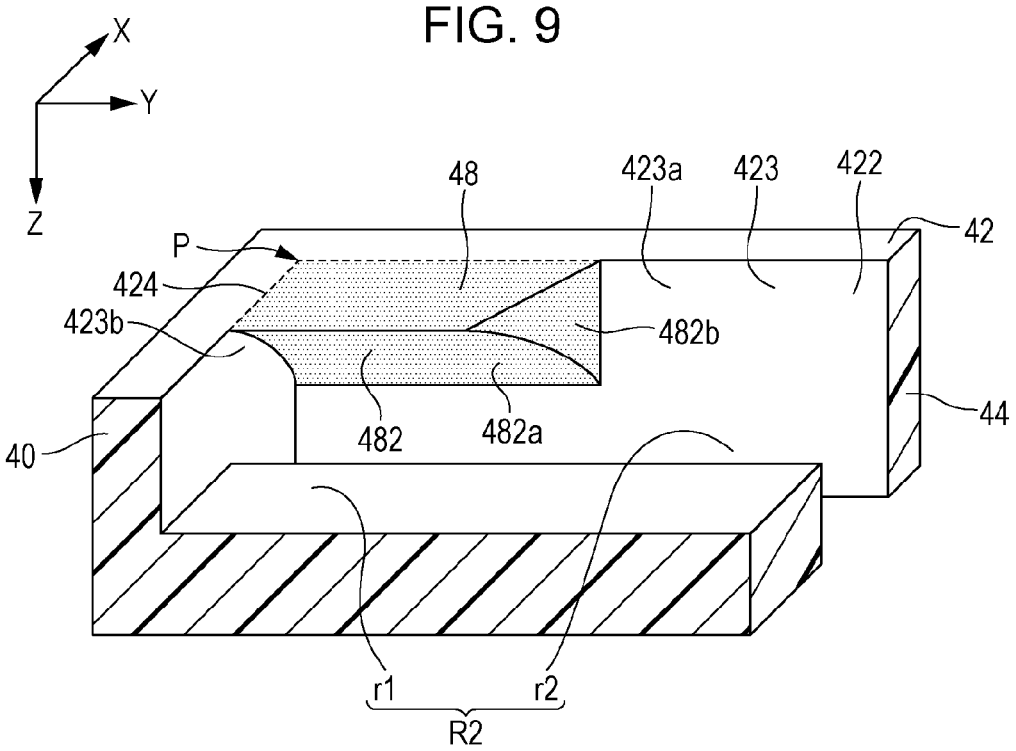
FIG. 9 is a partial perspective view which shows a first modification of an overhang portion of the liquid ejecting head.
Figure 10:
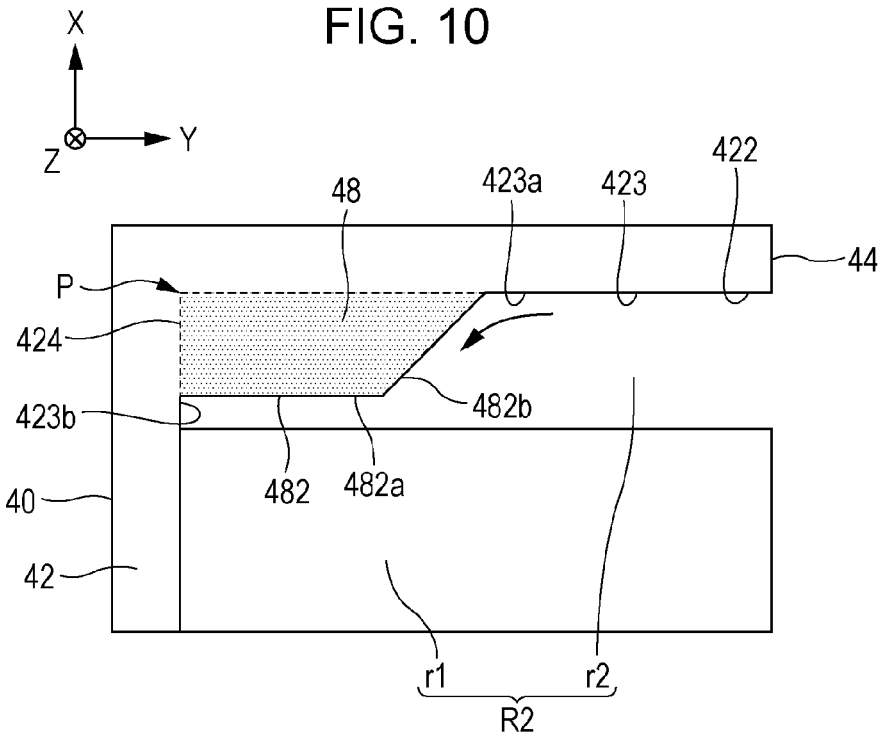
FIG. 10 is a plan view of the overhang portion shown in FIG. 9 as seen in the positive Z direction.

Furthermore, although FIG. 4 shows an example in which the underside of the overhang portion 48 is inclined and provided as the inclined surface 482, the invention is not limited thereto. For example, as shown in the first modification in FIG. 9, in addition to the underside of the overhang portion 48, a side surface of the overhang portion 48 on the positive Y direction side may also be inclined and provided as the inclined surface 482. FIG. 10 is a plan view of the overhang portion 48 shown in FIG. 9 as seen in the positive Z direction. The inclined surface 482 of the overhang portion 48 shown in FIG. 9 includes a first inclined surface section 482*a* (the underside of the overhang portion 48) which is inclined relative to the inner peripheral surface 423 of the opening 422 and the inner wall surface 462 of the seal plate 46, and a second inclined surface section 482*b* (the side surface of the overhang portion 48 on the positive Y direction side) which is inclined relative to both the inner peripheral surfaces 423*a*, 423*b* which are the inner peripheral surface 423 of the opening 422 and adjacent to and intersect with each other. In this configuration, the first inclined surface section 482*a* can provide a smooth ink flow between the inner peripheral surface 423 of the opening 422 and the inner wall surface 462 of the seal plate 46 (an ink flow as seen in the negative Y direction). Furthermore, as shown in FIG. 10, the second inclined surface section 482*b* can provide a smooth ink flow between the inner peripheral surfaces 423*a*, 423*b* of the opening 422 (an ink flow as seen in the Z direction). Since this facilitates discharge of air bubbles, discharge of air bubbles can be further improved.

Although the shape of the second inclined surface section 482*b* of the overhang portion 48 shown in FIG. 10 is formed of a straight line as seen in the Z direction, the invention is not limited thereto. A curved surface formed of a curved line as seen in the Z direction may also be possible. The shape of the second inclined surface section 482*b* of the overhang portion 48 having a curved surface can also provide a further smooth ink flow along the inner peripheral surface 423*a* of the opening 422.

In addition, the overhang portion 48 does not necessarily have a side surface. For example, as shown in the second modification in FIG. 11, the inclined surface 482 on the underside of the overhang portion 48 may be inclined relative to three surfaces, that is, the inner peripheral surfaces 423*a*, 423*b* which are the inner peripheral surface 423 of the opening 422 and adjacent to and intersect with each other and the inner wall surface 462 of the seal plate 46. In this configuration, a single inclined surface 482 can provide a smooth ink flow generated from the ink flow between the inner peripheral surface 423 of the opening 422 and the inner wall surface 462 of the seal plate 46 (the ink flow as seen in the negative Y direction) and the ink flow between the inner peripheral surfaces 423*a*, 423*b* of the opening 422 (the ink flow as seen in the Z direction). Since this facilitates discharge of air bubbles, discharge of air bubbles can be further improved.

Figure 11:
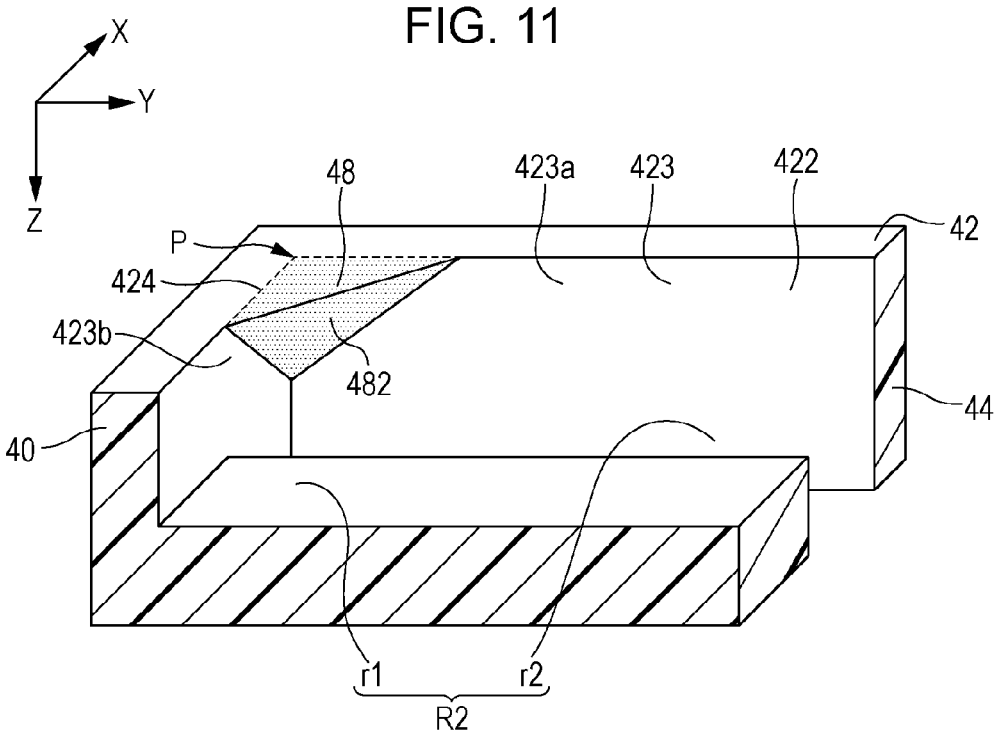
FIG. 11 is a partial perspective view which shows a second modification of the overhang portion of the liquid ejecting head.

Moreover, the top surface of the overhang portion 48 shown in FIG. 11 forms a triangular shape as seen in the Z direction. Accordingly, an area of the opening 422 is not decreased compared with the overhang portion 48 having a rectangular shape shown in FIGS. 4 and 9. This improves the prevention of decrease in absorption effect on pressure change by the seal plate 46. In addition, although the inclined surface 482 in FIG. 11 is a flat surface, the invention is not limited thereto. The inclined surface 482 in FIG. 11 may be, for example, a curved surface such as a portion of a spherical shape. In this configuration, the inclined surface 482 on the underside of the overhang portion 48 solely can provide a smooth ink flow as seen in the negative Y direction and a smooth ink flow as seen in the Z direction.

Figure 12:
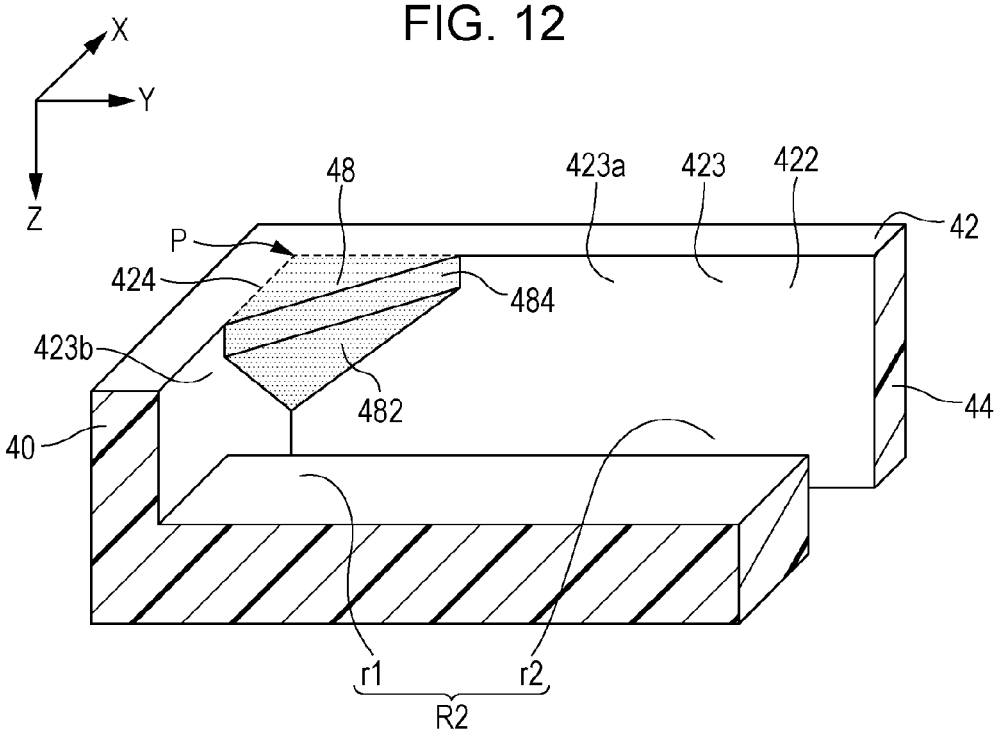
FIG. 12 is a partial perspective view which shows a third modification of the overhang portion of the liquid ejecting head.

Furthermore, a thick portion 484 may be provided on the overhang portion 48 at a position close to the seal plate 46 so that the inclined surface 482 is provided on the underside of the thick portion 484. For example, as shown in the third modification in FIG. 12, the thick portion 484 is provided on the overhang portion 48 of FIG. 11 to form the inclined surface 482 on the underside of the thick portion 484. In this configuration, a thickness of the top surface 42 in which the opening 422 is formed can be ensured, thereby improving a mechanical strength of the case member 40. Further, a sharp edge of the overhang portion 48 can be eliminated by providing the thick portion 484, thereby reducing a risk of contamination of broken pieces of the sharp edge into ink. Although FIG. 12 shows an example in which the thick portion 484 is provided on the overhang portion 48 of FIG.

11, the invention is not limited thereto. The thick portion 484 may be provided on the overhang portion 48 of FIGS. 4 and 9.

Second Embodiment

A second embodiment of the present invention will be described. The second embodiment shows a configuration which includes an opening 442 provided in the second portion r2 of the second space R2 in the liquid storage chamber SR to prevent pressure change, and a seal plate 47 that closes the opening 442. In the following examples, elements having the same effect and function as those of the first embodiment are denoted by the same reference numerals as those used in the first embodiment, and a detailed description thereof is omitted as appropriate.

Figure 13:
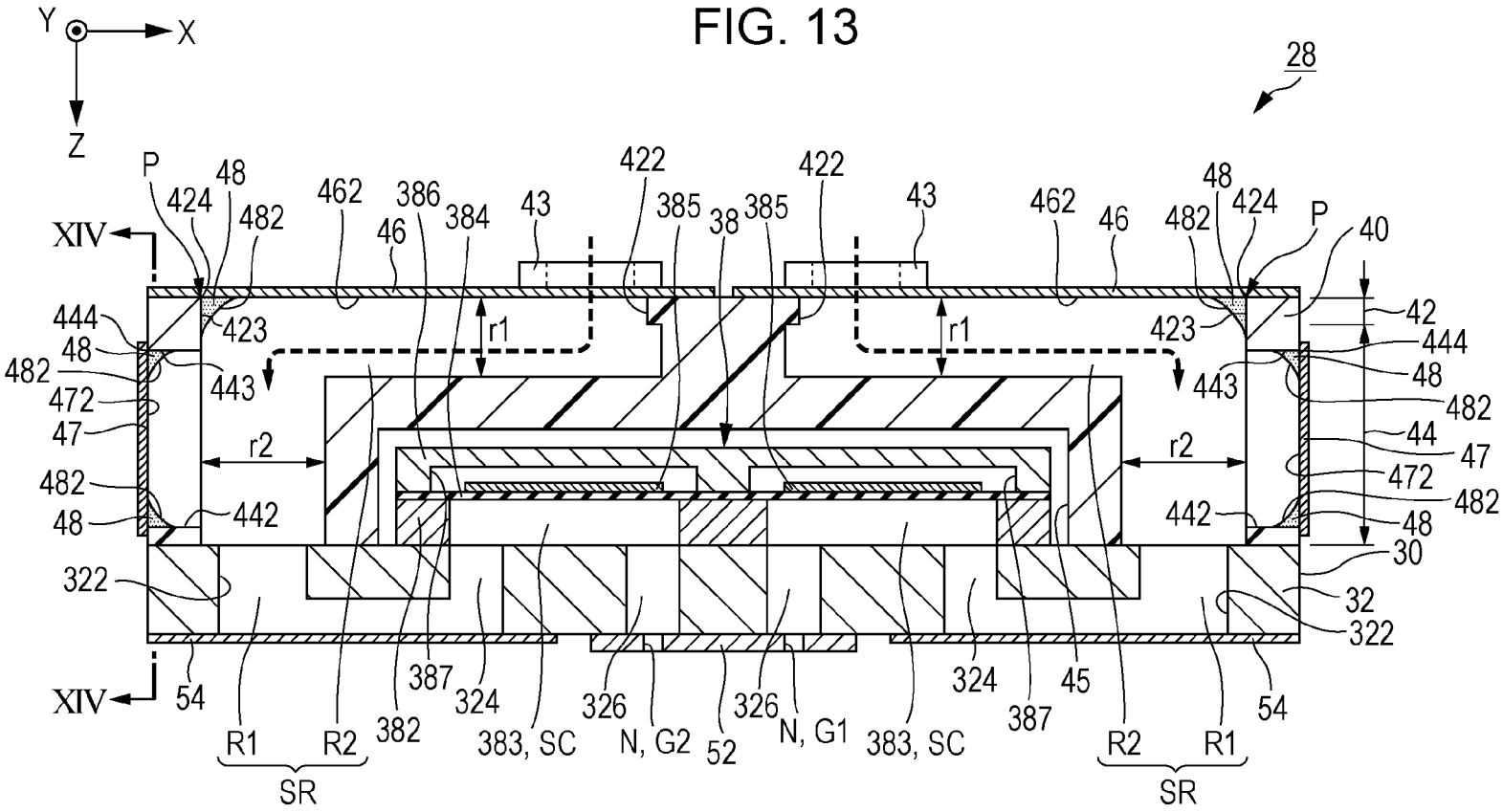
FIG. 13 is a cross sectional view of the liquid ejecting head of a printing apparatus according to a second embodiment of the present invention.
Figure 14:
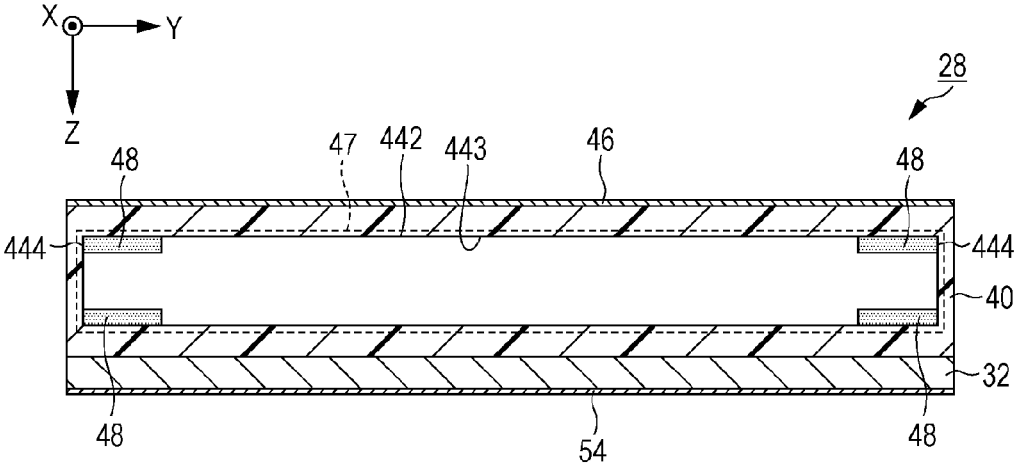
FIG. 14 is a cross sectional view of the liquid ejecting head shown in FIG. 13 taken along the line XIV-XIV.

FIG. 13 is a cross sectional view of the liquid ejecting head 28 of a printing apparatus according to a second embodiment of the present invention. FIG. 14 is a cross sectional view of the liquid ejecting head shown in FIG. 13 taken along the line XIV-XIV. As shown in FIGS. 13 and 14, in the liquid ejecting head 28 of the second embodiment, the opening 442 which communicates with the second portion r2 of the second space R2 is formed on the side surface 44 of the case member 40. The opening 422 is an opening that extends in the negative and positive Y directions, and communicates the second space R2 of the case member 40 and the outside space of the case member 40. As shown in FIG. 14, the opening 442 has a rectangular shape having the same width in the X direction from the end 424 on the negative Y direction side to the end 424 on the positive Y direction side.

As shown in FIGS. 13 and 14, seal plates (compliance substrates) 47 are disposed on the side surfaces 44. The seal plate 47 is a flexible film similarly to the aforementioned seal plate 54 and the seal plate 46, and serves together with the seal plate 54 and the seal plate 46 as a vibration absorber that absorbs pressure change of ink in the liquid storage chamber SR. The seal plate 47 is disposed on the outer wall surface of the side surface 44 so as to seal the opening 422 and forms the inner wall surface (side wall surface) of the liquid storage chamber SR. The seal plate 47 is located in the liquid storage chamber SR downstream of the seal plate 46, and is disposed vertical to the seal plate 46. Accordingly, in the second embodiment, pressure change in the liquid storage chamber SR can be reduced by an operation of the seal plate 54, the seal plate 46 and the seal plate 47.

In the opening 442 of the side surface 44, the inner peripheral surface 443 of the opening 442 intersects with the inner wall surface 472 of the seal plate 47. Since the opening 442 is a rectangular shape, four angular corners P are formed at the intersecting positions. Since a flow of ink is likely to stagnate at those four corners P, there is a risk of accumulation of air bubbles. In the second embodiment, as shown in FIGS. 13 and 14, the overhang portions 48 having the inclined surface 482 which overhangs from the inner peripheral surface 443 of the opening 422 are disposed on the ends 444 of the opening 442 (in this embodiment, two corners P on the positive Y direction side and two corners P on the negative Y direction side), that is, the inclined surfaces 482 are provided at all the four corners P.

According to the second embodiment having the above configuration, since the stagnation of ink flow can be reduced at four corners P at four ends 444 of the opening 442, discharge of air bubbles can be improved. Furthermore, in the second embodiment as well, since the overhang portions 48 are disposed on part of the opening 422 on the ends 444 on the positive and negative Y direction sides of the opening 442, a sufficient area of the opening 422 can be ensured compared with the case where the overhang portion 48 is disposed on the entire length of the opening 422 from the positive Y direction to the negative Y direction. Accordingly, it is possible to prevent decrease in absorption effect on pressure change by the seal plate 47. In addition, the opening 442 and the seal plate 46 may not be necessarily formed on the top surface 42 of the case member 40 of FIG. 13.

Modifications

A variety of modifications can be made to the examples described above. Embodiments of specific modifications will be described below. Two or more embodiments optionally selected from the following examples may be combined together to an extent not having inconsistencies to each other.

(1) An element (drive element) that applies pressure to the pressure chamber SC is not limited to the piezoelectric element 385 described in the above embodiments. For example, a heat generating element that changes pressure by generating air bubbles in the pressure chamber SC by heating can also be used as a drive element. As seen from the above examples, a drive element is comprehensively defined as an element that ejects liquid (typically, an element that applies pressure to the pressure chamber SC) regardless of operation methods (piezoelectric method/heating method) and specific configurations.

(2) The serial head is described in the above embodiments, in which the carriage 26, on which a plurality of liquid ejecting heads 28 are mounted, moves in the X direction. However, the present invention can also be applied to a line head in which a plurality of liquid ejecting heads 28 are arranged in the X direction.

(3) The printing apparatus 10 described in the above embodiments can be used for machines dedicated for printing, and various machines such as facsimile machines and copy machines. The applications of the liquid ejecting apparatus of present invention is not limited to printing. For example, the liquid ejecting apparatus that ejects solution of color materials is used for manufacturing machines for fabricating color filters of liquid crystal display devices. Further, the liquid ejecting apparatus that ejects solution of conductive materials is used for manufacturing machines for fabricating wiring and electrodes of wiring substrates.

The entire disclosure of Japanese Patent Application No. 2015-186807, filed Sep. 24, 2015 is expressly incorporated by reference herein in its entirety.

What is claimed is:

1. A liquid ejecting head comprising:

a head main body in which a nozzle that ejects liquid is formed;

a case member which includes a space that stores liquid to be supplied to the nozzle and an opening that communicates with the space;

a flexible seal plate that closes the opening from an outside of the case member; and an overhang portion disposed on an end of the opening and having an inclined surface that overhangs from an inner peripheral surface of the opening.

2. The liquid ejecting head according to claim 1, wherein the inclined surface of the overhang portion is inclined relative to the inner peripheral surface of the opening and an inner wall surface of the seal plate.

3. The liquid ejecting head according to claim 2, wherein the inclined surface of the overhang portion includes a first inclined surface section which is inclined relative to the inner peripheral surface of the opening and the inner wall surface of the seal plate, and a second inclined surface section which is inclined relative to the inner peripheral surfaces of the opening, the inner peripheral surfaces being adjacent to and intersect with each other.

4. The liquid ejecting head according to claim 1, wherein the inclined surface of the overhang portion is inclined relative to the inner peripheral surfaces of the opening, the inner peripheral surfaces being adjacent to and intersect with each other, and the inner wall surface of the seal plate.

5. The liquid ejecting head according to claim 1, wherein the overhang portion has a thickness between the inclined surface and the inner wall surface of the seal plate.

6. The liquid ejecting head according to claim 1, wherein the opening includes a first inner peripheral surface extending in a first direction, the overhang portion is disposed on an end of the first inner peripheral surface, and a length of the overhang portion in the first direction is not more than ⅛ of the entire length of the first inner peripheral surface.

7. The liquid ejecting head according to claim 1, wherein the inclined surface of the overhang portion is a curved surface.

8. The liquid ejecting head according to claim 1, wherein the case member is made of a resin material, and the overhang portion integrally formed with the case member.

9. A liquid ejecting apparatus comprising:

a transportation mechanism that transport a medium; and the liquid ejecting head that ejects liquid onto the medium according to claim 1.

* * * * *